United States Patent [19]

Carlson

[11] Patent Number: 4,867,267

[45] Date of Patent: Sep. 19, 1989

[54] HEARING AID TRANSDUCER

[75] Inventor: Elmer V. Carlson, Prospect Heights, Ill.

[73] Assignee: Industrial Research Products, Inc., Elk Grove Village, Ill.

[21] Appl. No.: 292,882

[22] Filed: Jan. 3, 1989

Related U.S. Application Data

[63] Continuation-in-part of Ser. No. 108,122, Oct. 14, 1987, Pat. No. 4,800,982.

[51] Int. Cl.[4] ..... H04R 25/00

[52] U.S. Cl. ..... 181/130; 181/135; 181/160; 381/68.6; 381/69.2; 381/159

[58] Field of Search ..... 181/126, 130, 132, 135, 181/160; 381/68.6, 69, 69.2, 187, 189, 159

[56] References Cited

U.S. PATENT DOCUMENTS

| | | | |
|---|---|---|---|
| 1,830,198 | 11/1931 | French | 181/135 |
| 2,312,534 | 3/1943 | French | 181/135 |
| 3,470,328 | 9/1969 | Daniels | 381/69.2 X |
| 3,602,330 | 8/1971 | Johnson | 181/135 |
| 3,702,123 | 11/1972 | Marken et al. | 181/135 |
| 3,918,550 | 11/1975 | Milkni | 181/135 |
| 3,934,100 | 1/1976 | Harada | 181/135 |
| 4,349,082 | 9/1982 | Gastmeier | 181/130 |
| 4,443,608 | 4/1984 | Warren | 181/135 X |
| 4,553,627 | 11/1985 | Gastmeier et al. | 181/135 |
| 4,679,650 | 7/1987 | Moser et al. | 181/130 |

OTHER PUBLICATIONS

Beranek, Leo L., "Acoustic Measurements", 1949, p. 225.

Olson, Harry F., "Acoustical Engineering", 1957, pp. 262–263.

*Primary Examiner*—B. R. Fuller

*Attorney, Agent, or Firm*—Kinzer, Plyer, Dorn, McEachran & Jambor

[57] ABSTRACT

This invention is concerned with a hearing aid including a microphone, an adjustable amplifier, and an acoustic transducer positioned within a first, large acoustic chamber defined by an in-the-ear housing. The acoustic transducer is in communication with a sound outlet passage which leads into the user's ear canal. The acoustic transducer includes a sound generating diaphragm driven by an acoustic driver. The diaphragm and driver are mounted in the acoustic transducer, with the diaphragm dividing the transducer into second and third acoustic chambers. A vent passage is provided between the first and third acoustic chambers. An acoustic resistance is mounted in the vent passage to modify the operating characteristics of the hearing aid.

4 Claims, 1 Drawing Sheet

HEARING AID TRANSDUCER

CROSS-REFERENCE TO RELATED APPLICATION

This application is a continuation-in-part of application Ser. No. 108,122, filed Oct. 14, 1987, Pat. No. 4,800,982.

BACKGROUND OF THE INVENTION

Hearing aids that are designed to be worn in the ear of the user have an orifice or outlet passage that is utilized to introduce sound from the hearing aid into the user's ear canal. It has been a common practice to position an acoustic resistance element or filter in that passage to modify the operating characteristics of the device. Mounting an acoustic resistance element in the sound outlet passage makes it subject to becoming clogged or fouled by the normal excretions that occur in the ear. Buildup of these excretions, referred to as ear wax or cerumen, ultimately causes them to migrate into the sound outlet passage where they interfere with the acoustic resistance element and block the passage. The resistance element not only tends to trap cerumen in the sound outlet passage but it also impedes circulation of cleaning fluids used to clean the passage.

SUMMARY OF THE INVENTION

A principal object of the invention is to provide a new and improved hearing aid or like sound reproduction device that fits into the user's ear and that includes an acoustic transducer that has increased low frequency sensitivity and that increases the maximum output sound pressure deliverable by the device.

Another object of the invention is to provide a new and improved acoustic transducer for an in-the-ear hearing aid or like device that is simple and economical of manufacture, yet durable, and that permits rapid cleaning in a simple manner without disassembling the device.

Accordingly, the invention relates to a hearing aid or like sound reproduction device of the kind that fits into an ear of a user, comprising a housing having a size and configuration adapted to fit into a human ear, and having a sound outlet passage of limited size, from the interior of the housing, that opens into the ear canal of the user, the interior of the housing comprising a first, large acoustic chamber. An acoustic transducer is positioned within the housing, in communication with the inner end of the sound outlet passage, and includes acoustic drive means mounted therein; a sound generating diaphragm is mounted in the acoustic transducer and driven by the acoustic drive means, the diaphragm dividing the transducer into second and third acoustic chambers which are each much smaller than the first acoustic chamber. There is a vent passage between the first and third acoustic chambers, and an acoustic resistance is mounted in the vent passage to modify the operating characteristics of the device.

DESCRIPTION OF THE PREFERRED EMBODIMENTS

Figure 1:
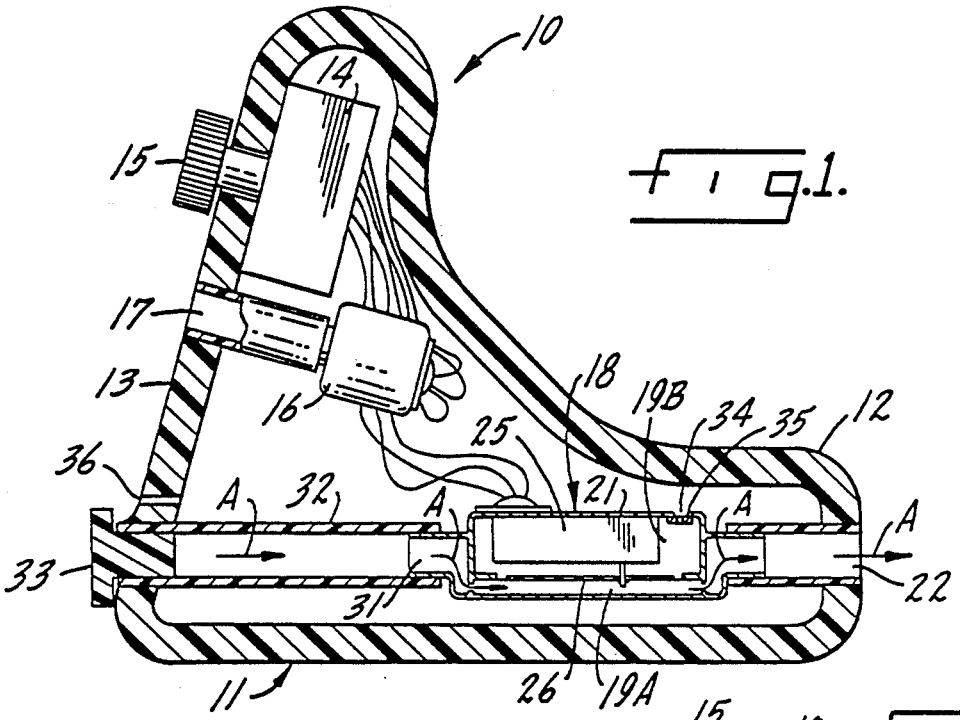
FIG. 1 is a sectional elevation view, on a greatly enlarged scale, of an in-the-ear hearing aid constructed in accordance with one embodiment of the present invention.

FIG. 1 illustrates an in-the-ear hearing aid 10 that is generally conventional in much of its construction but that has been modified so that it constitutes one of the preferred embodiments of the present invention.

The hearing aid 10 in FIG. 1 includes a shell-like housing 11 having a shape that affords a conformal fit within the ear of the intended user. The portion 12 of housing 11 projects into the user's ear canal. The outer portion 13 of housing 11, generally referred to as the faceplate, is usually located somewhere between the entrance of the ear canal and the entrance of the concha, depending upon the space available in the ear of the user and the skill of the hearing aid builder.

The housing or shell 11 encloses a first, large acoustic chamber 20. Hearing aid 10 includes an amplifier and battery assembly 14, usually equipped with at least one external control 15, in this instance mounted in chamber 20 immediately behind the faceplate 13. A microphone 16 is mounted within chamber 20. An acoustical connection comprising a tube 17 extends from microphone 16 through faceplate 13 to provide access to microphone 16 for externally arriving sound.

An acoustic transducer 18, sometimes referred to as a receiver, is also mounted within chamber 20 in housing 11, in communication with a sound outlet passage 22 that emerges from the hearing aid housing portion 12. Transducer 18 includes a small housing 21 within which an acoustic driver device 25 is mounted. This acoustic drive means 25, which is electrically actuated by signals from amplifier 14, is mechanically connected to a diaphragm 26 that extends across and divides the receiver housing 21 into a second acoustic chamber 19A and a third acoustic chamber 19B. Drive means 25 is located within the third or inner acoustic chamber portion 19B.

As thus far described, the in-the-ear hearing aid 10 is essentially conventional in its construction and in its operation. Thus, sound impinging upon the hearing aid reaches microphone 16 through the acoustical connection tube 17. Microphone 16 generates an electrical signal representative of the sound and supplies that signal to the amplifier/battery assembly 14. In amplifier 14, the amplitude for its output signal may be adjusted by control 15. Other characteristics (e.g., frequency response) may also be controlled in a similar manner.

Amplifier 14 supplies an electrical drive signal to the acoustic drive means 25 in transducer 18. Drive means 25 may be of conventional electromechanical construction; the driver could also be a piezoelectric device or other type of driver. In response to the received signals from amplifier 14, driver 25 actuates diaphragm 26 to generate acoustic (sound) signals that are supplied to the ear canal of the user through sound output passage 22. In most hearing aids, a small vent is provided between the two acoustic chambers 19A and 19B within receiver housing 21 to equalize changes in atmospheric pressure. This venting is usually necessary because the pressure differential acting on diaphragm 25, due to atmospheric pressure variations, may be sufficient to cause driver 25 to become inoperative. No such vent is shown in hearing aid 21 because other venting arrangements are employed as described hereinafter. In some instances, an acoustic resistance or damper may be mounted in the sound output duct or passage 22 to modify the frequency response characteristics of hearing aid 10. A resistance of this kind is preferably omitted in hearing aid 10.

The usual excretions of the ear, constituting ear wax or cerumen, may enter the open end of sound outlet passage 22 from the user's ear canal. Indeed, this is quite common because the outer end of passage 22 must be open in order to transmit sound to the ear canal of the user. These excretions tend to migrate into channel 22 to an extent such that the passage is eventually blocked, preventing hearing aid 10 from operating properly. Attempts to remove the cerumen may be partially successful, but eventually some of the ear wax is likely to move inwardly far enough to block the small passages leading from the second acoustic chamber 19A into the sound outlet passage 22. Indeed, enough of the cerumen may enter acoustic chamber 19A to impede the vibrations of diaphragm 26, effectively stopping operation of the hearing aid. If there is an acoustic resistance, filter, or damping element in passage 22, the likelihood of blockage is greatly increased.

Hearing aid 10, FIG. 1, incorporates a cleaning passage 32 that extends through faceplate 13 into housing 11 in direct communication with the innermost end of sound outlet passage 22. Actually, the cleaning duct 32 is connected to the second acoustic chamber 19A through a port 31; chamber 19A provides communication between diaphragm 26 and sound outlet passage 22. Thus, cleaning passage 32, port 31, acoustic chamber 19A, and sound outlet passage 22 comprise a continuous conduit that extends from faceplate 13 through housing 11 and out the tip end 12 of the housing, with one wall of the central part of that continuous conduit constituting diaphragm 26. A plug 33 normally closes the end of conduit 32 projecting through faceplate 13. Housing 21 of transducer 18 is vented by a small vent 34 into the interior of hearing aid housing 11, which in turn is vented to the atmosphere by a small opening 36 in faceplate 13. Vents 34 and 36 afford the necessary compensation for atmospheric pressure changes for acoustic chambers 20 and 19B.

Figure 2:
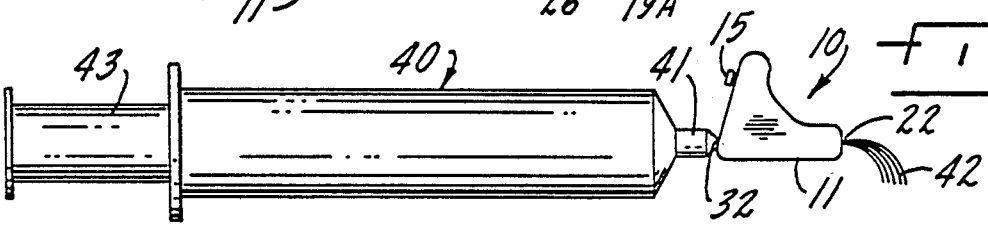
FIG. 2 is an essentially schematic illustration showing how the hearing aid of FIG. 1 is cleaned.

The manner in which accumulated ear wax or cerumen can be cleaned from hearing aid 10 is best illustrated in FIG. 2. Initially, plug 33 (FIG. 1) is removed. The tip 41 of a syringe 40 filled with a solvent for the cerumen is then inserted into the outer end of cleaning passage 32. When the plunger 43 of syringe 40 is depressed, the solvent flows through hearing aid 10 and is discharged from the outer, open end of sound outlet passage 22 as indicated at 42 in FIG. 2. The path of the solvent is illustrated, in FIG. 1, by arrows A.

In order to maintain sound outlet passage 22 unrestricted, it is preferable, as previously noted, that no filter, acoustic resistance, or other such element be mounted within the sound outlet passage. For acoustic damping or filtering, however, an appropriate acoustic resistance should be installed in vent 34 between the first, large acoustic chamber 20 and the third, small acoustic chamber 19B, as indicated by the acoustic resistance or damping element 35. Location of the damping means in this position has the beneficial effect of increasing the low frequency sensitivity of hearing aid 10, and also increases the maximum output sound pressure deliverable by receiver 18.

Venting of the large chamber 20 in housing 11 can also be achieved through unsealed openings associated with amplifier 14, control 15, tube 17, or microphone 16; the vent openings need not be located directly in faceplate 13 as indicated by vent 36. The location of vent opening 34 into the interior of receiver housing 21 may also be modified from that shown, so long as vent 34 and its acoustic resistance 35 are interposed between chambers 19B and 20.

As previously noted in connection with FIG. 2, an ordinary syringe 40 may be utilized to pump a quantity of a cleaning solvent through hearing aid 10. This action is effective to clean cerumen and other debris from the outer portion 19A of the acoustic chamber, from the face of diaphragm 26, and from all of outlet passage 22. After the ear wax and other debris is cleared the same syringe 40 (or another syringe) can be utilized to force drying air through the continuous conduit comprising passage 32, acoustic chamber portion 19A, and passage 22. In hearing aids and like transducers where it will not adversely effect the materials used for construction, an intermediate flush of alcohol or other rapidly evaporating solvent may be a substantial aid in the drying process.

Figure 3:
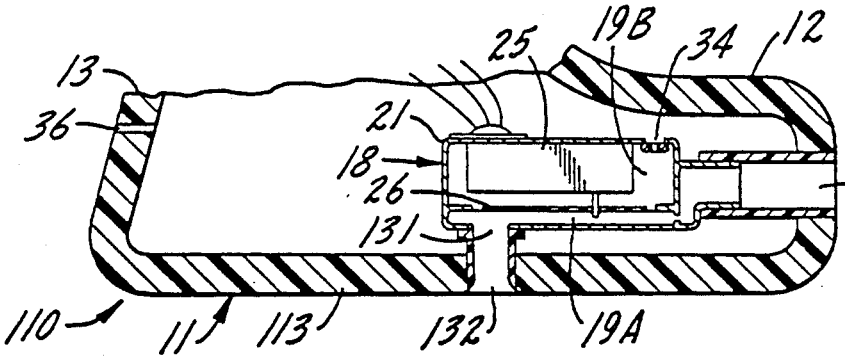
FIG. 3 is a detail sectional elevation view, similar to a portion of FIG. 1, of another embodiment of the invention.

FIG. 3 illustrates another construction for implementation of the invention that functions in essentially the same manner as the embodiment of FIG. 1. In the construction shown in FIG. 3, a hearing aid 110 of the same construction as the previously described hearing aid 10 is provided, except that cleaning passage 32 and plug 33 (FIG. 1) are eliminated. In hearing aid 110 there is a cleaning passage 132 which enters housing 11 through a side wall 113 and connects directly to the innermost end of portion 19A of the acoustic chamber, the end opposite outlet passage 22, through a port 131. No plug is necessary for channel 132 because its opening through wall 113 is effectively sealed off by contact with the surface of the user's ear canal. Clean-out operation for hearing aid 110 is the same as for hearing aid 10 of FIG. 1 in all respects, including effective cleaning of the surface of diaphragm 26 that is exposed to cerumen accumulation.

Figure 4:
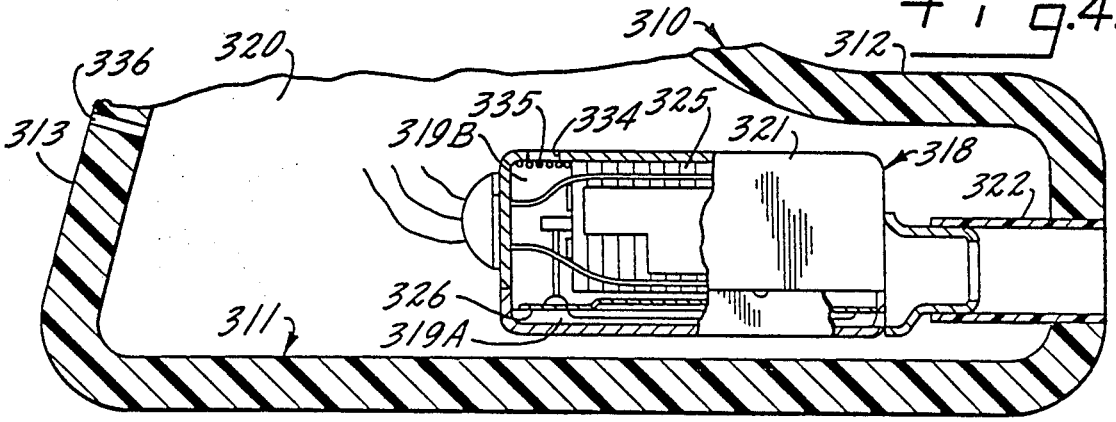
FIG. 4 is a detail sectional elevation view, similar to a portion of FIG. 1, of another embodiment of the invention.

FIG. 4 shows another construction for implementation of the invention. In the construction shown in FIG. 4, a hearing aid 310 of the same general construction as the previously described hearing aid 110 is provided, except that the cleaning passages are eliminated. Hearing aid 310 has a housing 311 which includes a faceplate 313, a side wall 311 and a tip portion 312. The housing defines within its interior a first, large acoustic chamber 320. A small opening 336 in faceplate 313 vents the first acoustic chamber to the atmosphere. Within the housing or shell, hearing aid 310 includes an amplifier and battery assembly (not shown), as well as a microphone and acoustic connection, as in the hearing aid 10. An external control similar to the control 15 (FIG. 1) is also provided.

An acoustic transducer 318, sometimes also called a receiver assembly, is mounted in the first acoustic chamber 320, in communication with a sound outlet passage 322. Passage 322 emerges from the hearing aid housing portion 312. Transducer 318 includes a generally hollow housing 321 which defines an interior space. This space is divided by a diaphragm 326 into a second acoustic chamber 319A and a third acoustic chamber 319B. An acoustic driver device 325 is mounted in the third chamber 319B. The acoustic drive means 325 is mechanically connected to the diaphragm 326. The third acoustic chamber 319B in transducer 318 is vented by a small vent 334 into the first acoustic chamber 320, which is quite large compared to the size of the third chamber. Vent 334 provides the necessary compensation for atmospheric pressure changes for acoustic chambers 320, 319B.

As in the previously-described embodiments, there is no acoustic resistance or damper mounted in the sound output passage 322 to modify the frequency response characteristics of the device. Instead, an appropriate acoustic damping element 335 is installed in chamber 319B just beneath vent 334. As mentioned above, this location of the acoustic resistance increases the low frequency sensitivity of the device and also increases the maximum output sound pressure deliverable by receiver 318. Furthermore, locating the resistance as shown precludes clogging of the resistance. These benefits can be obtained by placing the damping element in the specified location, without regard to the availability of cleaning passages. As will be noted, the device of FIG. 4 does not have cleaning passages. It does have improved low frequency sensitivity by virtue of the acoustic resistance mounted in the vent passage. Also, in a hearing aid without cleaning passages, clogging of a damping element in the sound passage effectively ends the useful life of the device. Since there is no damping device in the sound passage 322 of the hearing aid of this invention, the life of the hearing aid is considerably extended compared to the conventional design.

I claim:

1. A hearing aid or like sound reproduction device of a kind that fits into an ear of a user, comprising:

a housing having a size and configuration adapted to fit into a human ear, and having a sound outlet passage of limited size, from an interior of the housing, that opens into the ear canal of the user, the interior of the housing comprising a first, large acoustic chamber;

an acoustic transducer positioned within the housing, in communication with an inner end of the sound outlet passage, and including acoustic drive means mounted therein;

a sound generating diaphragm mounted in the acoustic transducer and driven by the acoustic drive means, the diaphragm dividing the transducer into second and third acoustic chambers which are each much smaller than the first acoustic chamber;

a vent passage between the first and third acoustic chambers; and an acoustic resistance mounted in the vent passage to modify the operating characteristics of the device.

2. The hearing aid or device according to claim 1 in which the sound outlet passage is in communication with the second acoustic chamber.

3. The hearing aid or device according to claim 1 in which the second acoustic chamber is small compared to the third acoustic chamber.

4. The hearing aid or device according to claim 1 and further comprising vent means for venting the first acoustic chamber to the air outside the housing.

* * * * *